US007677359B2

(12) United States Patent
Vigran et al.

(10) Patent No.: US 7,677,359 B2
(45) Date of Patent: Mar. 16, 2010

(54) SOUND ABSORBENT

(75) Inventors: Tor Erik Vigran, Trondheim (NO); Odd Petersen, Trondheim (NO)

(73) Assignee: Deamp AS, Trondheim (NO)

( * ) Notice: Subject to any disclaimer, the term of this patent is extended or adjusted under 35 U.S.C. 154(b) by 186 days.

(21) Appl. No.: 11/816,590

(22) PCT Filed: Mar. 23, 2006

(86) PCT No.: PCT/NO2006/000110

§ 371 (c)(1),
(2), (4) Date: Sep. 17, 2007

(87) PCT Pub. No.: WO2006/101403

PCT Pub. Date: Sep. 28, 2006

(65) Prior Publication Data

US 2008/0264720 A1 Oct. 30, 2008

(30) Foreign Application Priority Data

Mar. 23, 2005 (NO) ..... 20051536

(51) Int. Cl.
*E04B 1/82* (2006.01)
*E04B 1/84* (2006.01)
*E04B 1/74* (2006.01)

(52) U.S. Cl. ..... 181/293; 181/286

(58) Field of Classification Search ..... 181/293, 181/290, 286, 289, 210; 52/144, 145
See application file for complete search history.

(56) References Cited

U.S. PATENT DOCUMENTS

| | | | | |
|---|---|---|---|---|
| 1,536,666 | A * | 5/1925 | Franz | 52/675 |
| 3,269,484 | A * | 8/1966 | Lighter | 181/290 |
| 4,821,841 | A * | 4/1989 | Woodward et al. | 181/286 |
| 5,719,359 | A * | 2/1998 | Wolf et al. | 181/286 |
| 5,740,649 | A | 4/1998 | Fuchs et al. | |
| 5,905,234 | A * | 5/1999 | Tsukamoto et al. | 181/286 |
| 6,021,612 | A * | 2/2000 | Dunn et al. | 52/144 |
| 6,194,052 | B1 | 2/2001 | Knipstein | |
| 6,598,701 | B1 * | 7/2003 | Wood et al. | 181/290 |
| 6,617,002 | B2 * | 9/2003 | Wood | 428/131 |
| 7,434,660 | B2 * | 10/2008 | Yamagiwa et al. | 181/293 |
| 2001/0050197 | A1 * | 12/2001 | Wood | 181/292 |
| 2005/0133302 | A1 * | 6/2005 | Pfaffelhuber et al. | 181/293 |
| 2006/0289229 | A1 * | 12/2006 | Yamaguchi | 181/290 |
| 2008/0135327 | A1 * | 6/2008 | Matsumura et al. | 181/151 |

FOREIGN PATENT DOCUMENTS

| | | | |
|---|---|---|---|
| DE | 4316843 | | 11/1994 |
| DE | 19754107 | | 2/1999 |
| EP | 1146178 | | 2/1999 |
| JP | 02136407 | A * | 5/1990 |
| JP | 02136408 | A * | 5/1990 |
| WO | 03030144 | | 4/2003 |

* cited by examiner

*Primary Examiner*—Edgardo San Martin
(74) *Attorney, Agent, or Firm*—Dennison, Schultz & MacDonald

(57) ABSTRACT

Sound absorbent (1) of a hard material, such as metal, glass, hard plastic or composites thereof, for absorption of acoustic waves by friction of viscous flow, essentially in the frequency range between 100 and 4000 Hz. The sound absorbent (1) comprises a panel element (3) with microslits (5) therethrough, said microslits (5) having a minimum slit width (b) of less than 0.45 mm. When in use, the panel element (3) is arranged with a distance to a rear surface.

22 Claims, 2 Drawing Sheets

SOUND ABSORBENT

The invention relates to a sound absorbent for absorption of acoustic waves and especially to a planar shaped sound absorbent.

BACKGROUND OF THE INVENTION

In various types of indoor environments, such as office premises, receptions and reception halls, production premises, sports halls and indoor swimming pools, playgrounds and classrooms, it is desirable and also statutory according to regulations, to provide good acoustic conditions to the environment. Acoustic conditions can be best described by the reverberation, and to control this, sound absorbing elements are used, such as sound absorbing panels attached to walls, ceilings, and other surfaces.

Sound absorbing panels as surfaces for attachment to indoor walls and ceilings come in types that use various physical effects for the absorption of sound. Firstly, there are so-called fibre absorbents. These comprise porous panels of mineral fibres (rock and glass wool), which dampen sound as the sound waves penetrate into the panel, and the energy of the sound waves is reduced by viscous losses in the pores and absorbed by the fibres as heat.

Furthermore, there exist absorbents, which are based on the Helmholz resonator principle. Such panels generally include slits or apertures, and require fibre fabric or porous fibre materials behind the panel to obtain satisfactory absorption. Normally, a fibre fabric is used, but this is often combined with thicker fibre mats to obtain better absorption. In the latter case, the fibre fabric is often integrated as a surface layer on the fibre mat.

Another type of absorbent is membrane absorbent. The most common type is thin panels of metal, such as steel or aluminium, or of plastic, which is mounted at a certain distance from a wall or ceiling. A special type is disclosed in patent publication U.S. Pat. No. 5,719,359. Here, the sound is absorbed as the sound energy creates movement in a membrane, in the form of thin strips. The general problem with membrane absorbents is that the resistive component, which makes them function as an absorbent, is small, and moreover, is almost impossible to estimate. This is partially solved by arranging the strips against each other, yielding friction as they move as a result of the sound.

Patent publication U.S. Pat. No. 4,821,841 discloses a panel element for sound absorption, with a panel with slits arranged over a rear plate. The slits are approximately 1.6 to 19 mm wide, and the panel element is adapted to have fibre material arranged in the space between the panel with slits and the rear plate, to obtain the desired absorption.

There are various weaknesses with such fibre-based sound absorbing panels. An important one is that they produce fibres to the environment in the event of damage or wearing. Such fibres are often made of melted glass or rock, and give the sensation of dry air and irritation of the respiratory passages of persons in such environments. Furthermore, these fibres limit the appearance of such plates. It is difficult to keep them clean as they require minimum use of moisture when cleaning, and problems related to mould and decay may arise, especially in rooms exposed to moisture, such as kitchens, indoor swimming pools and the like.

Another type of panel avoids these drawbacks by using friction by viscous airflow to dampen the sound waves. Such known panels comprise microperforations, i.e. holes through the panel of diameters less than 0.5 mm. These panels are not dependent on fibre materials. The panel is arranged with a distance from a rear surface, in such way that an air space is formed between the microperforated panel and the rear surface. As the sound waves hit the panel, the air in the perforations is forced back and forth due to the pressure differences resulting from the sound waves. This movement results in viscous friction, by which the energy in the sound waves is converted to heat, whereby the sound waves are dampened.

Such a sound absorbing panel element is disclosed in patent publication WO 03001501. This panel element is intended for sound isolation of car engines and the like, but can also be used as sound absorbing elements in buildings. The panel element consists of a panel with microperforations, arranged at a distance to a rear surface, with the perforated panel facing the sound source. This panel element avoids the disadvantages of fibre based sound absorbents, as described above.

Microperforated panels and foils are in many cases produced by rolling a tool with many small spikes over the surface or the foil. Other methods, such as laser cutting and plastic moulding are used for thicker panels and for panels of other materials.

A need in the market for new absorbents that allow for architects' desire for a clean and smooth surface is identified. With its low perforation level and special design, the present invention provides a solution to the market, which complies with this need. Products based on the invention can be adapted to the individual customer's needs concerning surface finish, shape, and choice of material.

SUMMARY OF THE INVENTION

The object of the invention is to provide a new type of sound absorbent, which avoids the above-mentioned drawbacks of fibre based sound absorbents, and which simultaneously exhibits better absorption characteristics and is less costly to produce than many known sound absorbents based on microperforations. It is also an object of the invention to open new fields of use and to provide design-related advantages compared to known sound absorbents.

It has been recognized that it is possible to produce another type of sound absorbent without fibre materials, which provides good sound absorption using friction of viscous flow. Such a sound absorbent is obtained with a sound absorbent according to the invention, and comprises a panel element with microslits there through, which panel element, when in use, is arranged at a distance from a rear surface, creating a space between the panel element and the rear surface. By the term microslits is meant slits with a minimum slit width less than 0.45 mm.

Corresponding to the microperforated panels, with the sound absorbent according to the invention, the sound waves are dampened by friction of viscous flow. Due to pressure changes resulting from the sound waves, the air in the small slits is forced back and forth, and the energy in the sound waves is converted into heat due to the friction of the viscous flow. To obtain this vibration of air in the slits, the rear surface is at a distance from the panel element, so that the air pressure in the air between the panel element and the rear surface will fluctuate due to acoustic waves that impact the panel element and its slits.

The term panel element herein means the outer part of the sound absorbent, which constitutes a wall or a shell or the like facing the surroundings in such a way that it is arranged between the surroundings and a rear space, which rear space is at least partially confined by the panel element and the mentioned rear surface. Thus, by using the term panel element, it is not intended to limit the shape to a planar shaped plate. Hence, the sound absorbent's panel element can essentially be shaped to an arbitrary form, for instance a ball, a rod, or a more "organic" arbitrary form, as long as the principle for sound absorption according to the present invention is ensured.

The panel element of the sound absorbent is made of a hard material, such as metal, glass, ceramics, hard plastic etc. Herein hard material means materials that are so hard that their surface will not vibrate essentially in relation to the surrounding air when the surrounding air pressure fluctuates, or the surrounding air vibrates, respectively, as a result of acoustic waves. Hence, the term materials means materials that are sufficiently hard to ensure the mode of operation according to the invention.

The sound absorbent according to the invention is primarily intended for use on walls and ceilings and other surfaces in building rooms. However, it may also be used for sound dampening of various sources of noise, such as engines, or as sound absorbent for other arrangements, such as in buses or trains, or in ventilating systems.

The absorption characteristic of the sound absorbent according to the invention is dependent on various parameters. Such parameters comprise slit width, slit distance, panel element thickness, and the distance between the panel element and the rear surface. In rooms with noise in the form of speech, such as in indoor swimming pools, conference rooms, office premises, reception halls and class rooms, it is desired that the sound absorbent primarily absorbs sound with frequencies in the speech range, i.e. approximately 250-4000 Hz. In such rooms, speech communication is important, and thus the use of sound absorbents to optimize the reverberation is important. High frequencies are normally sufficiently absorbed by other parts of the interior, such as furniture, curtains, persons and carpets. The mentioned parameters can thus be set in such a way that the sound absorbent absorbs especially well at low and medium frequencies. The sound absorbent will preferably be adapted to absorb in the frequency range between 100 and 2000 Hz, and can also be adapted to absorb in the frequency range between 100 and 4000 Hz.

BRIEF DESCRIPTION OF THE DRAWINGS

In the following is presented an example of an embodiment of a sound absorbing sound absorbent according to the invention, with reference to the drawings, where.

DESCRIPTION OF THE PREFERRED EMBODIMENTS

Figure 1:
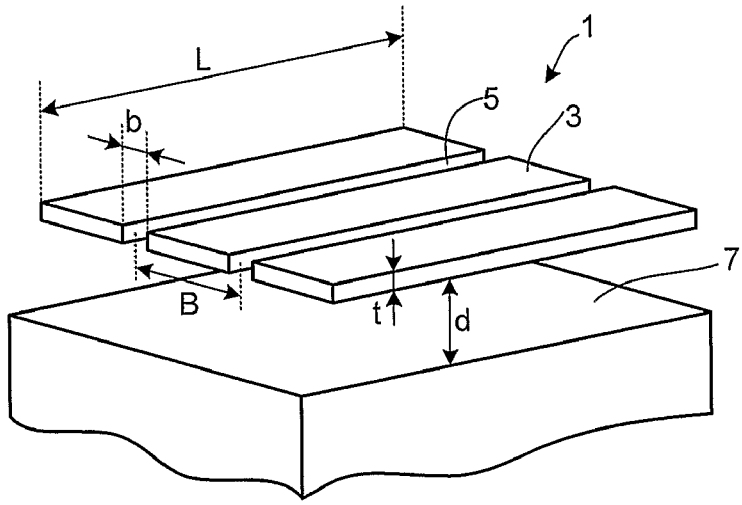
FIG. 1 illustrates a principle drawing of a sound absorbent according to the invention.

FIG. 1 is a principle drawing of a sound absorbent 1 according to the invention, comprising a panel element 3 with slits 5, arranged at a distance from a rear surface 7. Of the four parameters mentioned above, FIG. 1 indicates the width b of the slit, the distance B between the centre lines of adjacent slits 5, the thickness t of the panel element 3, and the distance d between the panel element 3 and the rear surface 7. The drawing in FIG. 1 only illustrates the principle of the design, and differs from a genuine embodiment of a sound absorbent according to the invention.

The slit width b is preferably less than 0.4 mm. Larger slit widths than this will yield poor absorption by friction of viscous flow. Advantageously, the slit width b is less than 0.3 mm. The distance between the panel element 3 and the rear surface 7 is preferably between 30 and 500 mm. This distance influences the frequency range for which the sound absorbent absorbs, as larger distances result in lower-frequency absorption. To obtain a desired absorption in the speech-range, a distance of 30 to 150 mm will be adequate. If one wants even lower frequency absorption, this distance can be raised to about 500 mm. The thickness of the panel element 3, and hence the depth of the slits 5, is advantageously maximum 20 mm, and preferably maximum 10 mm. This relates to both the absorption spectrum and the cost aspect. With a thicker panel element, one will obtain a narrow absorption spectrum, something that one wants to avoid, as one wants a sound absorbent that absorbs in a wide frequency range. Furthermore, it is cheaper to produce with thinner panel elements.

Each panel or sound absorbent 1 in FIG. 1 may have a surface area in the region of between about 600×600 mm and 1200×1800 mm, but can also be shaped into other sizes. The sound absorbents 1 can have square or rectangular shapes, which will be suitable for the facing of walls and ceiling, for instance, but may also be produced with other essentially arbitrary shapes. The shaping of the sound absorbent will primarily be limited in that an essentially confined space shall exist behind the panel element, the extent of which is at least defined by the panel element and the aforementioned rear surface.

The relationship between the length L of the slits 5 and the slit width b is advantageously at least 50, and preferably at least 100. To achieve the production-related advantages of slits in lieu of holes, the slits must have a certain minimum length, as this will reduce the number of work steps during production.

Figure 2:
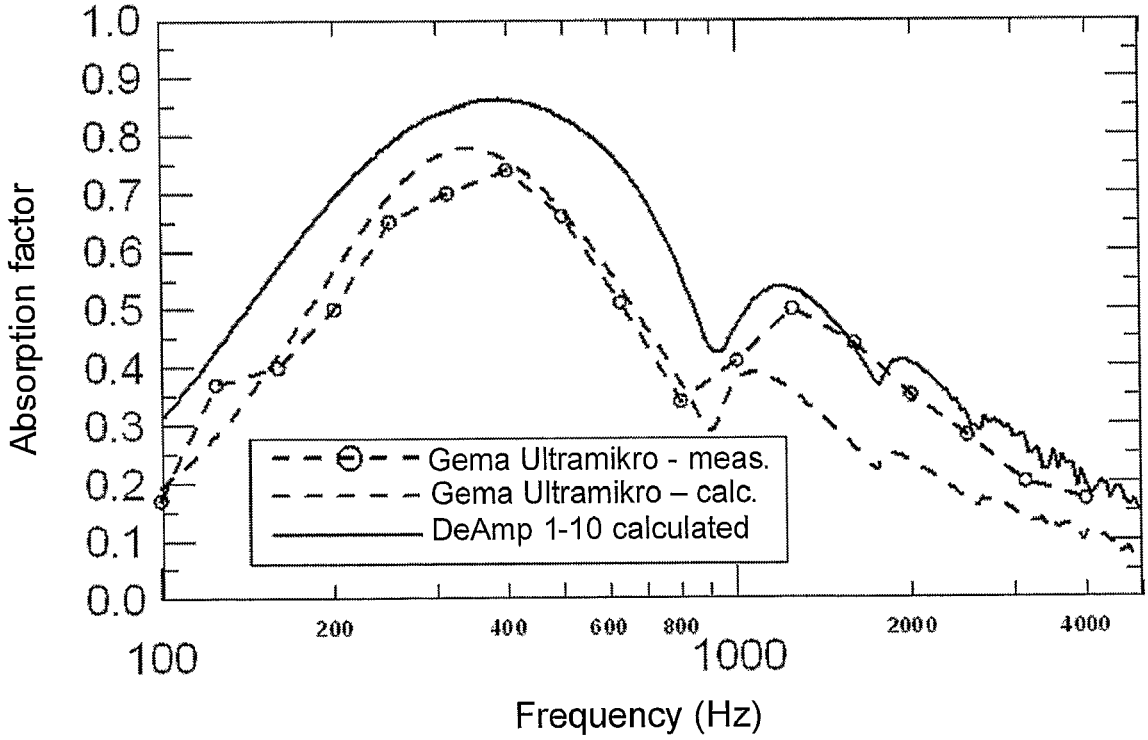
FIG. 2 illustrates a comparison of the absorption characteristics of a known sound absorbing panel with microperforations and a sound absorbent according to the invention.

FIG. 2 shows the result of a comparison of the absorption characteristics of a sound absorbing panel with microperforations and a sound absorbent according to the invention. The sound absorbing panel with microperforations is known under the name Gema Ultramicro®, and has microperforations of 0.45 mm diameter. The characteristics of this product are both measured and estimated. As appears from FIG. 2, the measurements agree well with the estimates. The measurements were performed in a reverberation chamber, according to ISO 354. The estimates were performed with the software WinFLAG™. For the sound absorbent according to the invention, here with a planar/plate form, called DeAmp, the characteristics as presented in FIG. 2 were estimated. Other variants of the DeAmp sound absorbents have been measured with both small and large samples, and the tests agree well with the estimates. The DeAmp sound absorbent has slit widths of 0.2 mm, and both sound absorbents has a distance between the panel element and the rear surface of 200 mm. As appears from FIG. 2, the sound absorbent according to the invention has a higher and broader absorption curve than the sound absorption panel Gema Ultramicro®. Furthermore, they both have their primary absorption range in the frequency range between approximately 100 and 1000 Hz. The measurements for Gema Ultramicro® in the treble range exhibit higher absorption than estimated. This is due to surface absorption, which is not considered in the estimates. A corresponding effect can be expected for the DeAmp sound absorbent.

The comparison described above with reference to FIG. 2, illustrates that the sound absorbent according to the invention absorbs sound better than the mentioned product with microperforations for the same frequency range.

To achieve a better absorption characteristic, i.e. a broader and/or higher absorption curve (FIG. 2), it is possible to arrange one or more additional panel elements with microslits between the rear surface and the panel element described above. This or these panel element(s) may have different slit widths, distances between the slits, and panel thicknesses. In this way it is possible to design a sound absorbent according to the invention with desired absorption characteristics.

It is also possible to arrange other, known types of sound absorbents between the panel element and the rear surface to achieve the desired absorption characteristics.

The sound absorbent according to the invention, and especially its panel element, can advantageously be produced in metal, such as aluminium or steel, or other hard materials, such as glass, ceramic, rock or hard plastic. It is also possible to manufacture the sound absorbent in certain types of wood or composites of these mentioned materials. The wide range of possible materials renders large possibilities of variation for the appearance of the sound absorbent. Hence it can be adapted to various types of rooms and styles. Furthermore, it is possible to use the panel elements for surfaces other than only ceilings and walls. For instance, they can be shaped as mirrors or associated with windows.

The panel element of the sound absorbent can be manufactured in different ways, depending on the choice of materials and the various parameters. For metals, laser cutting of slits in a panel element is a cheap and quick way of manufacture. Another way is to make smaller panel elements, and to mount these with a distance to each other that corresponds to the desired slit width. This is possible for both metals and glass, but will be most appropriate where laser cutting cannot be used. For sound absorbents in plastic, moulding will be a cost efficient way of manufacture.

These production methods provide great flexibility for the design. For instance, the slits can be formed as a zigzag-pattern, instead of being straight as in FIG. 1. A zigzag-pattern will result in a longer length of the slit and better absorption properties. The slits can also have the shape of letters, or other arbitrary shapes.

For slits that are essentially mutually parallel to adjacent slits, such as straight, wave-shaped, or zigzag-shaped slits, appropriate distance between the slits, i.e. the distance between centre lines of adjacent slits, is advantageously between 5 and 75 mm.

In general, for slits of arbitrary shape, such as slits shaped as letters or other patterns, for instance, a perforation level in the panel element of less than 3% is advantageous.

Figure 3:
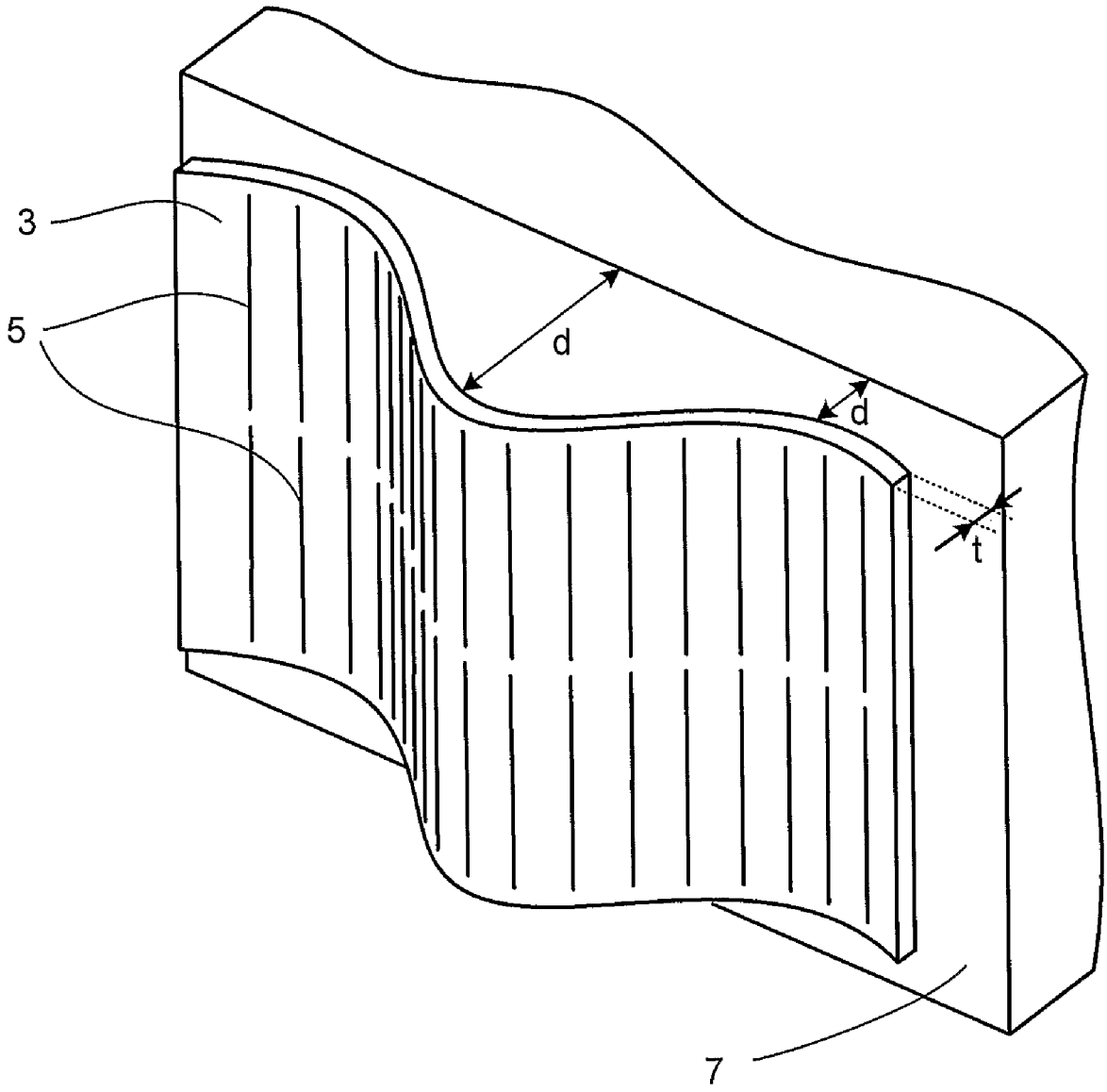
FIG. 3 illustrates a more arbitrary shape of the panel element of a sound absorbent according to the invention.

FIG. 3 illustrates an example of a more arbitrary form of the panel element 3 than what is shown in FIG. 1. As appears from FIG. 3, the panel element 3 can also have a varying distance to the rear surface 7, due to the shape of the panel element. The illustrated panel element has straight, parallel slits 5. As mentioned, these could also have had a more arbitrary shape, such as letters or other patterns.

Because of the small slit widths b in the panel 3, the slits 5 will barely be visible. Hence, the panel elements 1 stand out as clear, smooth surfaces. Furthermore, the low perforation level causes the elements to reflect much of the light that falls onto them, something that makes them well suited for the use as false ceilings, where it is often desirable to reflect the light.

A big advantage of the sound absorbent according to the invention is that it tolerates water. Hence, it can be easily washed. It may even be washed with a high-pressure washer, a feature that is very desirable in environments as for instance rooms exposed to moisture, indoor swimming pools, commercial kitchens, and slaughterhouses. Washing is often a problem for fibre-based absorbents, as problems related to decay and mould may arise if they are exposed to moisture.

The sound absorbents according to the invention can advantageously be manufactured as panels, adapted to be mounted directly onto an existing wall, so that the existing wall functions as the rear surface. False ceilings may be manufactured as clamping cassettes, using standardized suspension systems and an independent rear plate. Alternatively, the sound absorbent can be manufactured to comprise both the panel element with microslits and an additional, rear mounted plate.

The invention claimed is:

1. Sound absorbent of a hard material for absorption of acoustic waves by friction of viscous flow, essentially in the frequency range between 100 and 4000 Hz, comprising a panel element constructed and arranged for mounting at a predetermined distance from a rear surface, creating a space therebetween, the panel element having a predetermined thickness (t), and having microslits therethrough, each said microslit having a predetermined length (L) and width (b), the width (b) being substantially uniform throughout the length (L) thereof and throughout the thickness (t) of the panel, and each said microslit having a width (b)≦0.45 mm, wherein each said microslit has a ratio (L):(b) between the length (L) and the width (b) of at least 50.

2. Sound absorbent according to claim 1, wherein the hard material is selected from the group consisting of metal, glass, hard plastic, and composites thereof.

3. Sound absorbent according to claim 1, adapted for sound absorption essentially in the frequency range of 100 to 2000 Hz.

4. Sound absorbent according to claim 1, wherein the predetermined distance between the panel element and the rear surface is between 30 and 500 mm.

5. Sound absorbent according to claim 1, wherein the rear surface is a part of the sound absorbent.

6. Sound absorbent according to claim 1, wherein the panel element has a perforation level of less than 3%.

7. Sound absorbent according to claim 1, wherein adjacent slits are arranged to have center lines with a distance therebetween of between 5 and 75 mm.

8. Sound absorbent according to claim 1, wherein the ratio between the length (L) and the width (b) of the slits is at least 100.

9. Sound absorbent according to claim 1, wherein the thickness (t) of the panel element is no more than 20 mm.

10. Sound absorbent according to claim 9, wherein the thickness (t) of the panel element is no more than 10 mm.

11. Sound absorbent according to claim 1, wherein at least one additional panel element with microslits is arranged between the panel element and the rear surface.

12. Sound absorbent according to claim 1, wherein an additional sound absorbent of another type is arranged between the panel element and the rear surface.

13. Sound absorbent according to claim 1, wherein the width (b) of the slits is less than 0.4 mm.

14. Sound absorbent according to claim 13, wherein the width (b) of the slits is less than 0.3 mm.

15. Sound absorbent according to claim 1, wherein the width (b) of the slits is at least 0.2 mm.

16. Sound absorbent according to claim 1, wherein the panel element comprises wood.

17. Sound absorbent according to claim 1, essentially comprising glass or acrylic, and adapted for use as a part of a transparent implementation.

18. Sound absorbent according to claim 1, wherein the slits are manufactured by use of laser.

19. Sound absorbent according to claim 1, wherein the slits are created by separate panel elements being arranged adjacent each other with spaces corresponding to the microslits.

20. A sound absorbent of substantially planar shape of a hard material for absorption of acoustic waves by friction of viscous flow, essentially in the frequency range between 100 and 2000 Hz, comprising:

a panel element with microslits therethrough, having a predetermined thickness (t), each said microslit having a predetermined length (L) and width (b), the width (b) being substantially uniform throughout the length (L) thereof and throughout the thickness (t) of the panel, each said microslit having a width (b)≦0.45 mm, wherein each said microslit has a ratio (L):(b) between the length (L) and the width (b) of at least 50; and a rear surface arranged at a predetermined distance from the panel element, creating thereby a space between the panel element and the rear surface.

21. Sound absorbent according to claim 20, wherein the distance between the panel element and the rear surface is between 30 and 500 mm.

22. Sound absorbent according to claim 20, wherein adjacent slits are arranged to have center lines with a distance therebetween of between 5 and 75 mm.

* * * * *